US007853158B2

(12) United States Patent
Mikuni

(10) Patent No.: US 7,853,158 B2
(45) Date of Patent: Dec. 14, 2010

(54) IMAGE FORMING APPARATUS AND PROCESS CARTRIDGE

(75) Inventor: Atsushi Mikuni, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 79 days.

(21) Appl. No.: 12/411,725

(22) Filed: Mar. 26, 2009

(65) Prior Publication Data

US 2009/0269086 A1 Oct. 29, 2009

(30) Foreign Application Priority Data

Apr. 25, 2008 (JP) ..... 2008-115709

(51) Int. Cl.
*G03G 15/00* (2006.01)

(52) U.S. Cl. ..... 399/12; 399/111; 399/113

(58) Field of Classification Search ..... 399/9, 399/12, 24, 25, 27, 58, 61, 110, 111, 113, 399/119, 120
See application file for complete search history.

(56) References Cited

U.S. PATENT DOCUMENTS

| | | | | |
|---|---|---|---|---|
| 6,298,202 | B1 | 10/2001 | Fushiya et al. | |
| 6,311,026 | B1 * | 10/2001 | Higeta et al. | 399/13 |
| 6,738,589 | B2 * | 5/2004 | Karakama et al. | 399/111 |
| 6,983,114 | B2 * | 1/2006 | Arimitsu | 399/114 |
| 7,139,493 | B2 * | 11/2006 | Ito et al. | 399/12 |
| 7,512,347 | B2 | 3/2009 | Suzuki et al. | |
| 7,630,661 | B2 * | 12/2009 | Noda et al. | 399/67 |
| 2006/0193646 | A1 | 8/2006 | Suzuki et al. | |
| 2007/0058993 | A1 | 3/2007 | Horinoe | |
| 2007/0122165 | A1 | 5/2007 | Igarashi et al. | |

FOREIGN PATENT DOCUMENTS

| | | |
|---|---|---|
| JP | 5-204195 A | 8/1993 |
| JP | 07-160173 | 6/1995 |
| JP | 08-179614 | 7/1996 |
| JP | 09-114166 | 5/1997 |
| JP | 2000-221781 A | 8/2000 |
| JP | 2001-159842 | 6/2001 |
| JP | 2001-222204 | 8/2001 |

(Continued)

OTHER PUBLICATIONS

JP Office Action dtd Apr. 27, 2010, Appln. 2008-115709, English translation.

*Primary Examiner*—Hoan Tran
(74) *Attorney, Agent, or Firm*—Banner & Witcoff, Ltd.

(57) ABSTRACT

An image forming apparatus has: a photosensitive cartridge; a development cartridge detachably mounted to the photosensitive cartridge; a main body in which the photosensitive cartridge is detachably mounted; a first sensor; a second sensor; and a control unit. Where the second sensor is brought into a second state after being temporarily brought into a first state, it is determined that the development cartridge is a new one. Where the second sensor is in the first state and the first sensor receives light within a predetermined period of time, it is determined that both the development cartridge and the photosensitive cartridge are not mounted Where the second sensor is in the first state, and the first sensor does not continuously receive the light for a predetermined period of time, it is determined that the photosensitive cartridge is mounted and the development cartridge is not mounted.

8 Claims, 10 Drawing Sheets

FOREIGN PATENT DOCUMENTS

| | | | |
|---|---|---|---|
| JP | 2004-077988 | A | 3/2004 |
| JP | 2006-267994 | A | 10/2006 |
| JP | 2007-079121 | | 3/2007 |
| JP | 2007-148285 | | 6/2007 |
| JP | 2007249069 | | 9/2007 |

* cited by examiner

FIG. 10

| | WAVEFORM OF NEW ARTICLE DETECTION SENSOR | WAVEFORM OF TONER EMPTY SENSOR | RESULTS OF DETERMINATION |
|---|---|---|---|
| 1 | ON ON OFF | OFF | PHOTOSENSITIVE CARTRIDGE MOUNTED<br>DEVELOPMENT CARTRIDGE MOUNTED (NEW ONE)<br>TONER PROVIDED |
| 2 | ON | OFF | PHOTOSENSITIVE CARTRIDGE MOUNTED<br>DEVELOPMENT CARTRIDGE MOUNTED (OLD ONE)<br>TONER PROVIDED |
| 3 | ON | ON | PHOTOSENSITIVE CARTRIDGE MOUNTED<br>DEVELOPMENT CARTRIDGE MOUNTED (OLD ONE)<br>TONER NOT PROVIDED |
| 4 | OFF | OFF | PHOTOSENSITIVE CARTRIDGE MOUNTED<br>DEVELOPMENT CARTRIDGE NOT MOUNTED |
| 5 | OFF | ON | PHOTOSENSITIVE CARTRIDGE NOT MOUNTED<br>DEVELOPMENT CARTRIDGE NOT MOUNTED |

IMAGE FORMING APPARATUS AND PROCESS CARTRIDGE

CROSS REFERENCE TO RELATED APPLICATION

The present application claims priority from Japanese Patent Application No. 2008-115709, which was filed on Apr. 25, 2008, the disclosure of which is herein incorporated by reference in its entirety.

TECHNICAL FIELD

Apparatuses and devices consistent with the present invention relate to an image forming apparatus and a process cartridge mounted in the image forming apparatus.

BACKGROUND

Japanese unexamined patent application publication No. JP-A-2007-079121 describes a related art image forming apparatus such as a laser printer. The related art image forming apparatus has a photosensitive body on which an electrostatic latent image is formed by being exposed to light in accordance with an image to be formed, and a development cartridge for supplying a developer (toner) to the photosensitive body. Although the photosensitive body is an expendable item, the service life thereof is not coincident with the period of use in which toner is consumed in the development cartridge. Therefore, the photosensitive body is constructed so as to be replaced in the form of another cartridge (photosensitive cartridge) separate from the development cartridge.

Consumption of the photosensitive cartridge and the development cartridge may be checked by counting the number of times of image formation. Therefore, it is necessary to securely detect mounted states of the photosensitive cartridge and the development cartridge.

Therefore, the above described related art image forming apparatus has a technology for detecting toner cartridge (development cartridge) and a drum cartridge (photosensitive cartridge). In the related art image forming apparatus, using optical sensors to detect toner being empty, it is determined whether or not toner exists, whether a toner cartridge exists and whether a drum cartridge exists. In detail, in the toner cartridge, optical sensors are placed with the toner accommodating chamber disposed therebetween, and a window is provided at the position corresponding to a light path of the optical sensors on the wall of the toner accommodating chamber. And, the window is periodically cleaned by a wiper to ensure passing of light, and light is temporarily interrupted by passing of the wiper. In addition, a through hole is formed at the front side of the window on the wall of the drum cartridge opposed to the window, and at the same time, an interrupting member (shutter), which is opened in accordance with mounting of the toner cartridge, is provided at the through hole portion.

With such a configuration, the determinations described above are carried out by detection states of light by the optical sensors. That is, the quantity of toner is detected by the ratio of the period during which light is detected. If no light is detected, it is determined that the toner cartridge is not mounted, and if light is continuously detected, it is determined that the drum cartridge is not mounted.

SUMMARY

However, the related art image forming apparatus has a few disadvantages. For example, in the related art image forming apparatus, since the determination is carried out by referring to the cycle of light interruption by means of the wiper, it is difficult to determine that light is interrupted by toner or by the interrupting member where the remaining quantity of toner is large, wherein there may be a case where erroneous determination occurs. That is, there is a problem that determination is difficult with respect to whether the development cartridge is mounted or whether the remaining quantity of toner is large although the development cartridge is mounted.

In this point, although sensors to determine whether the development cartridge exists and whether the photosensitive cartridge exists are separately provided, the determination can be facilitated. However, if sensors are separately provided, another problem arises in that the cost is increased.

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus capable of determining, at high accuracy, whether a development cartridge exists and whether a photosensitive cartridge exists, without providing exclusive sensors for each of the development cartridge and the photosensitive cartridge.

According to an exemplary embodiment of the present invention, there is provided an image forming apparatus, comprising: a photosensitive cartridge having a photosensitive body; a development cartridge that is detachably mounted to the photosensitive cartridge and supplies developer to the photosensitive body; and a main body in which the photosensitive cartridge is detachably mounted; wherein the development cartridge includes: a developer accommodating portion; and a light transmission portion formed on the developer accommodating portion, the main body includes: a first sensor that is configured to detect light passing through the light transmission portion; a second sensor that is configured to be movable between a first state and a second state by being brought into contact with the development cartridge when the development cartridge is mounted in the main body; a development cartridge driving member that is configured to drive a member in the development cartridge in engagement with the development cartridge; and a control unit that is configured to determine, based on outputs of the first sensor and the second sensor, whether the developer exists in the developer accommodating portion, whether the photosensitive cartridge is mounted, and whether the development cartridge is mounted, wherein the development cartridge further includes: a new article detecting member that is a portion configured to be brought into contact with the second sensor and moves by drive of the development cartridge driving member, the new article detecting member configured such that, by drive of the development cartridge driving member, the new article detecting member is irreversibly moved to a new article state where the new article detecting member is brought into contact with the second sensor, to a new article-detected state where the new article detecting member is separated from the second sensor, and to a new article detection-completed state where the new article detecting member is again brought into contact with the second sensor, in order, and is thereafter stopped, the photosensitive cartridge further includes: a shutter that is disposed to be opposed to the light transmission portion, the shutter configured to open the light transmission portion in line with mounting of the development cartridge in the photosensitive cartridge, and configured to shut the light transmission portion in line with separation of the development cartridge, and wherein the control unit is configured to determine, when the second sensor is brought into the second state after the second sensor is temporarily brought into the first state, that the development cartridge is a new article, the control unit configured to determine, when the second sensor is in the first state and the first sensor receives the light within a predetermined period of time, that both the photosensitive cartridge and the development cartridge are not mounted, and the control unit configured to determine, when the second sensor is in the first state and the first sensor does not receive the light continuously for a predetermined period of time, that the photosensitive cartridge is mounted and the development cartridge is not mounted.

According to the above exemplary embodiment, if the second sensor is used to detect a new article of the development cartridge, it is possible to securely detect whether the development cartridge exists. That is, the new article detecting member is constructed so that, by drive of the development cartridge driving member, the new article detecting member is irreversibly moved to a new article state where the same is brought into contact with the second sensor, to a new article-detected state where the same is separated from the second sensor, and to a new article detection-completed state where the same is again brought into contact with the second sensor, in order, and is thereafter stopped. If the development cartridge is a new one, the second sensor is brought into the second state after being temporarily brought into the first state, and is finally stopped in the second state. Accordingly, it is possible to determine whether the development cartridge exists in addition to whether the development cartridge is a new one. And, based on the result that it is possible to securely determine whether the development cartridge exists, it can be determined that both the photosensitive cartridge and the development cartridge are not mounted if the second sensor is in the first state and the first sensor receives detection light within a predetermined period of time. Further, where the second sensor is in the first state and the first sensor does not continuously receive detection light for a predetermined period of time, it can be determined that the photosensitive cartridge is mounted and the development cartridge is not mounted.

Also, according to the exemplary embodiment, there is provided a process cartridge detachably mounted in a main body of an image forming apparatus, the process cartridge comprising: a photosensitive cartridge having a photosensitive body; and a development cartridge detachably mounted to the photosensitive cartridge, the development cartridge supplying developer to the photosensitive body, wherein the development cartridge includes: a developer accommodating portion; and a light transmission portion formed on the developer accommodating portion, the main body includes: a first sensor that is configured to detect light passing through the light transmission portion; a second sensor that is configured to be movable between a first state and a second state by being brought into contact with the development cartridge when the development cartridge is mounted in the main body; and a development cartridge driving member that is configured to drive a member in the development cartridge in engagement with the development cartridge, wherein the development cartridge further includes: a new article detecting member that is a portion configured to be brought into contact with the second sensor and moves by drive of the development cartridge driving member, the new article detecting member configured such that, by drive of the development cartridge driving member, the new article detecting member is irreversibly moved to a new article state where the new article detecting member is brought into contact with the second sensor, to a new article-detected state where the new article detecting member is separated from the second sensor, and to a new article detection-completed state where the new article detecting member is again brought into contact with the second sensor, in order, and is thereafter stopped, the photosensitive cartridge further includes: a shutter that is disposed to be opposed to the light transmission portion, the shutter configured to open the light transmission portion in line with mounting of the development cartridge in the photosensitive cartridge, and configured to shut the light transmission portion in line with separation of the development cartridge.

According to the exemplary embodiment of the present invention, since a sensor for detecting a new article can be concurrently used for determining whether the development cartridge exists, it is possible to determine, at high accuracy, whether the development cartridge and the photosensitive cartridge exist, without providing exclusive sensors for each of the development cartridge and the photosensitive cartridge.

BRIEF DESCRIPTION OF THE DRAWINGS

Illustrative aspects of the invention will be described in detail with reference to the following figures wherein:

FIG. 10 is a table showing the relationship between determination conditions in the control unit and the results thereof.

DETAILED DESCRIPTION OF EXEMPLARY EMBODIMENTS OF THE PRESENT INVENTION (Entire Configuration of Color Printer)

Figure 2:
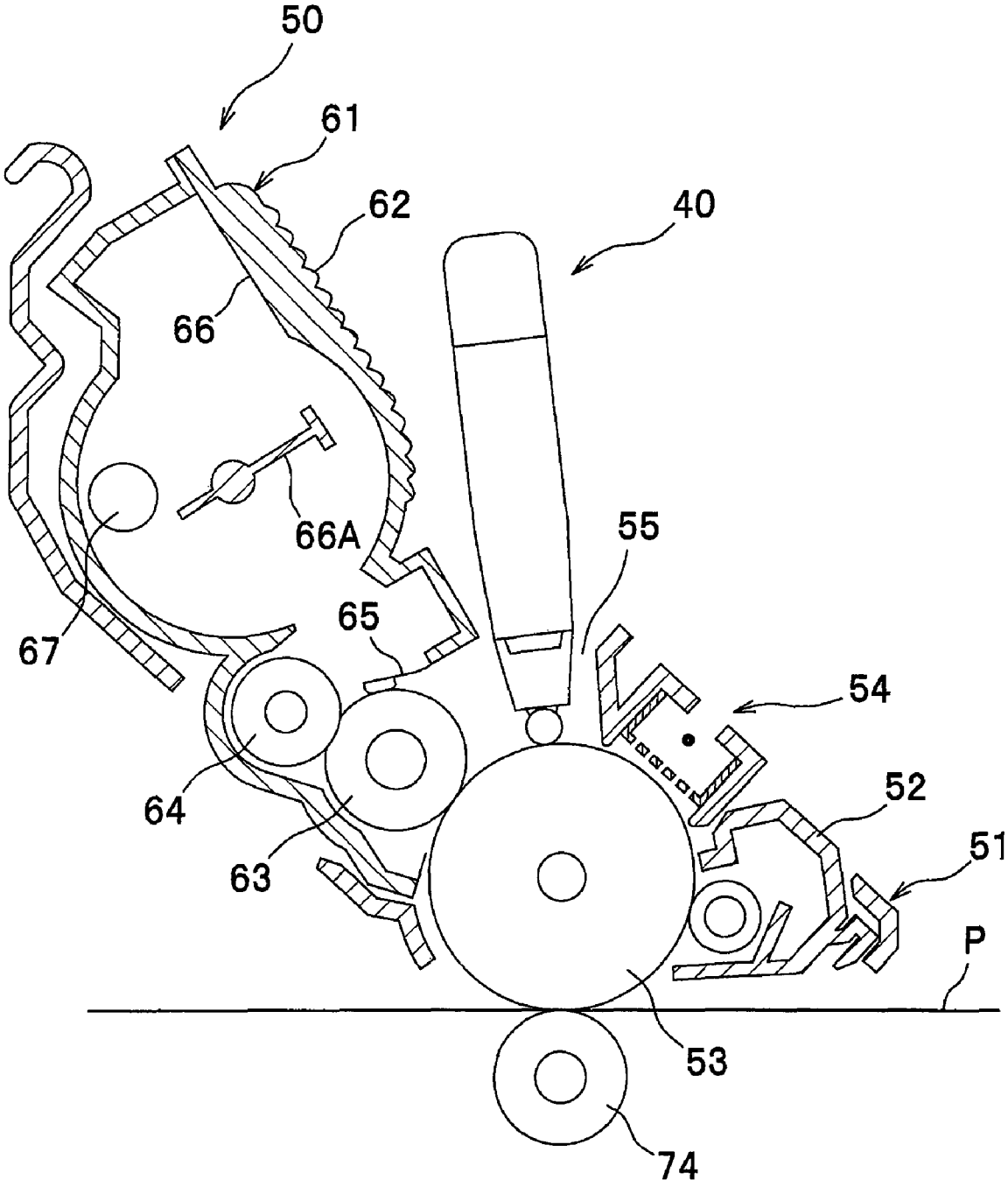
FIG. 2 is an enlarged sectional view of a process cartridge.
Figure 3:
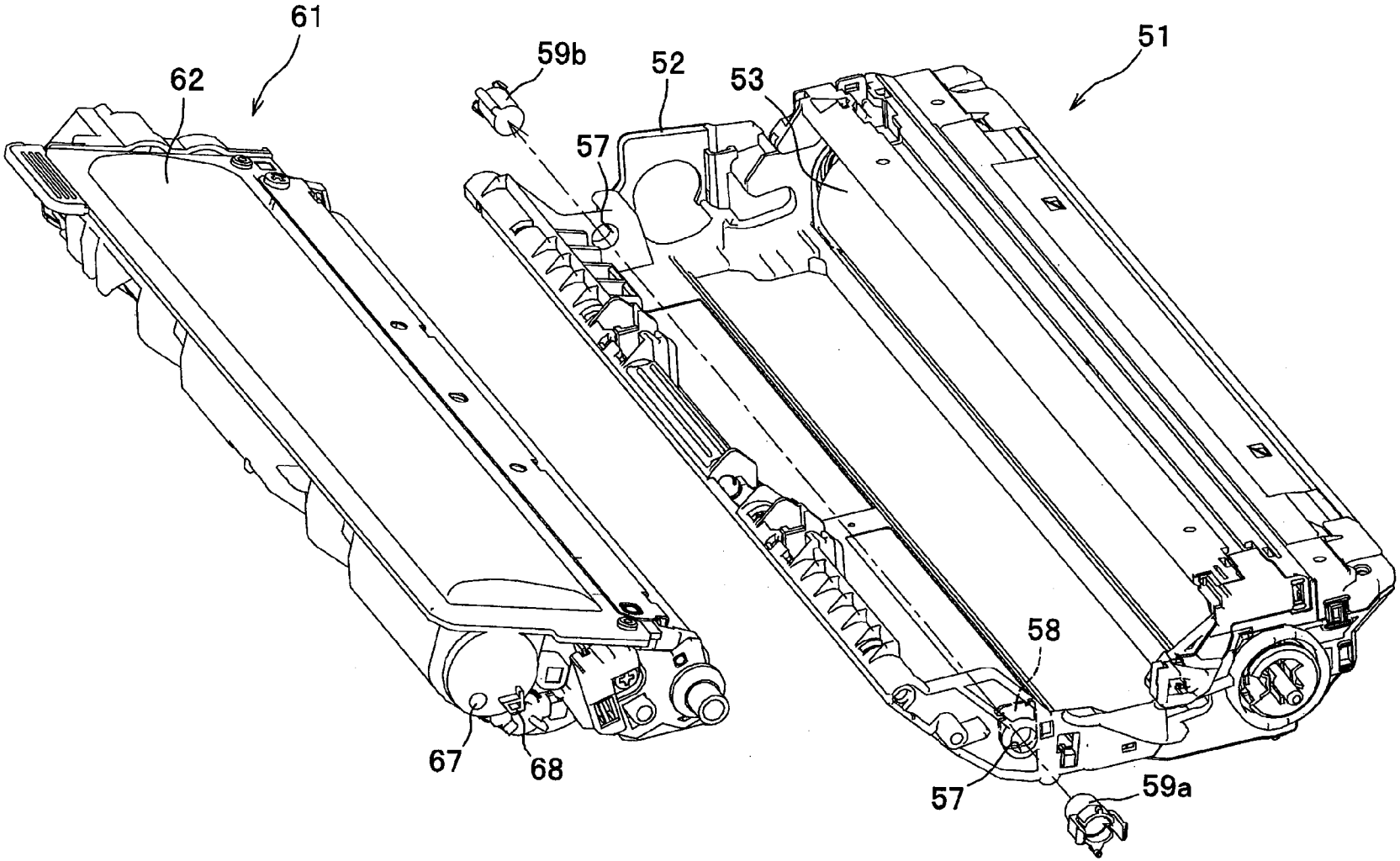
FIG. 3 is a perspective view showing a development cartridge and a photosensitive cartridge.

Next, a detailed description is given of an exemplary embodiment of the present invention with reference to the appropriate drawings. In the drawings to be referred to, FIG. 1 is a sectional view showing an entire configuration of a color printer as an example of an image forming apparatus, FIG. 2 is an enlarged sectional view of a process cartridge, and FIG. 3 is a perspective view of a development cartridge and a photosensitive cartridge.

In the following description, the direction is described in the direction based on a user status when using a color printer. That is, in FIG. 1, the left side facing the paper surface is regarded as the front side, the right side facing the paper surface is regarded as the back side, the back side facing the paper surface is regarded as the left side, and the front side facing the paper surface is regarded as the right side. In addition, the vertical direction facing the paper surface is regarded as the up-down direction.

Figure 1:
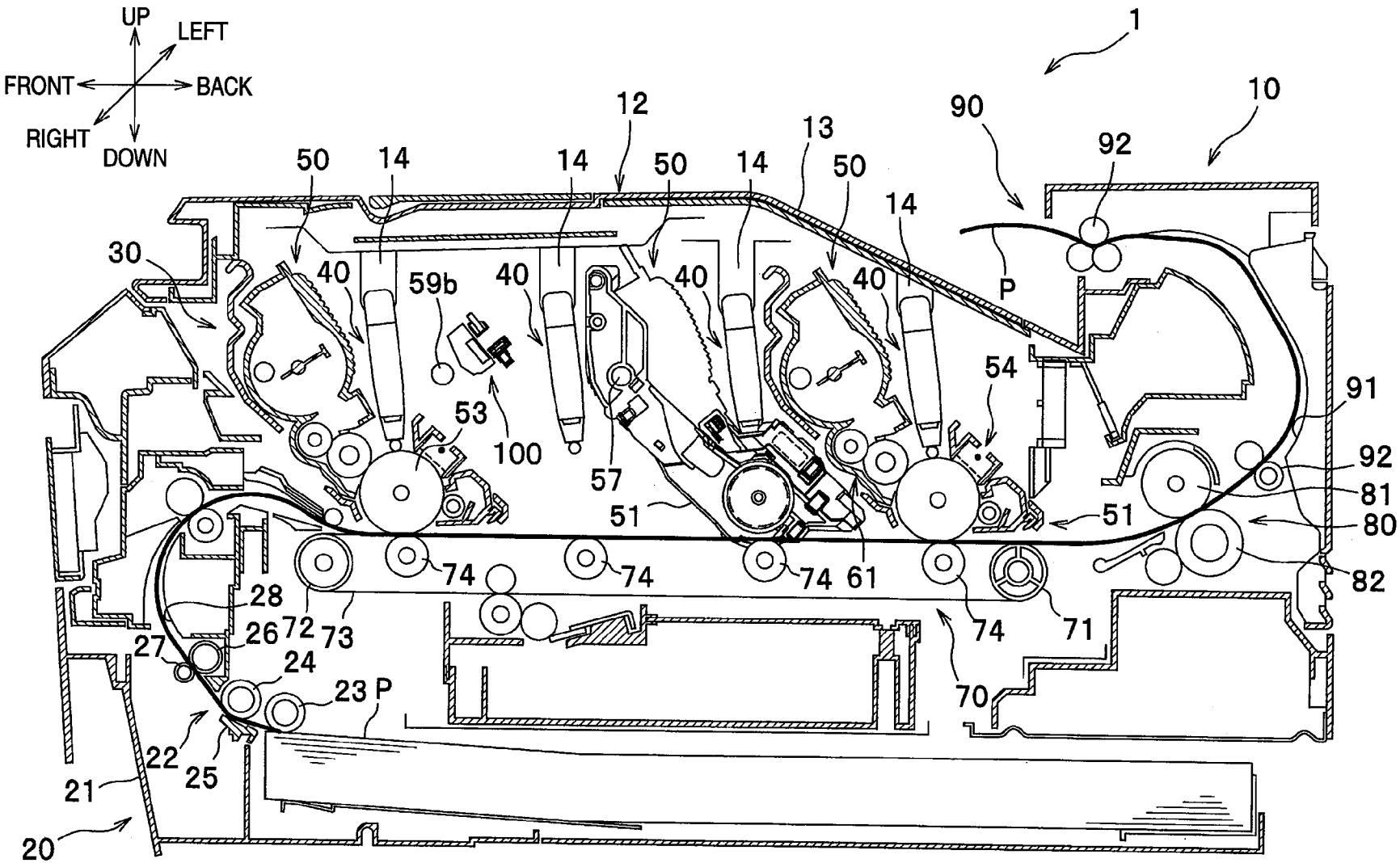
FIG. 1 is a sectional view showing the entire configuration of a color printer as an example of an image forming apparatus.

As shown in FIG. 1, a color printer 1 includes a sheet feeding unit 20 for feeding sheets P, an image forming unit 30 for forming images on fed sheets P, and a sheet discharge unit 90 for discharging sheets P on which images are formed, in the main body housing 10 as an example of the main body.

An upper cover 12 that can be opened and closed is provided at the upper part of the main body housing 10 so as to vertically turn on the supporting point of hinges (not illustrated) secured at the backside thereof. The upper surface of the upper cover 12 is made into a sheet discharging tray 13 on which sheets P discharged from the main body housing 10 are accumulated, and a plurality of retainer members 14 for holding an LED unit 40 are attached to the underside of the upper cover 12.

The sheet feeding unit 20 is provided at the lower part in the main body housing 10 and includes a sheet feeding tray 21 removably mounted at the main body housing 10 and a sheet conveyance mechanism 22 for conveying sheets P from the sheet feeding tray 21 to the image forming unit 30. The sheet feeding mechanism 22 is provided at the front side of the sheet feeding tray 21, and includes a sheet feeding roller 23, a separation roller 24 and a separation pad 25.

In the sheet feeding unit 20 thus constructed, sheets P in the sheet feeding tray 21 are separated sheet by sheet and are sent upward. After paper powder is removed in the course of passing between a paper powder removing roller 26 and a pinch roller 27, the direction of the sheets is turned over backward while passing through the conveyance path 28, and sheets are fed to the image forming unit 30.

The image forming unit 30 includes four LED units 40, four process cartridges 50 (three thereof are shown in FIG. 1) and a transfer unit 70, and a fixing unit 80.

The process cartridges 50 are arranged and disposed in the front-back direction between the upper cover 12 and the sheet feeding unit 20, and each of the process cartridges 50 includes, as shown in FIG. 2, a photosensitive cartridge 51 and a development cartridge 61 removably mounted to the photosensitive cartridge 51. The process cartridge 50 supports the photosensitive drum 53. Also, with respect to the respective process cartridges 50, only the colors of toner accommodated in a developer accommodating portion 66 of the development cartridge 61 are different from each other, wherein the configurations thereof are the same.

The photosensitive cartridge 51 includes a drum frame 52, a photosensitive body drum 53 as an example of a photosensitive body rotatably supported on the drum frame 52, and a charger 54 supported on the drum frame 52.

The drum frame 52 is devised so as to form an exposure hole 55 to view the photosensitive body drum 53 from the outside with the developing cartridge 61 being mounted. As shown in FIG. 2, the LED unit 40 is inserted into the exposure hole 55 so that the LED unit 40 is opposed to the upper surface of the photosensitive drum 53.

The development cartridge 61 includes a development frame 62, development roller 63 and a supply roller 64, which are rotatably supported on the development frame 62, a thickness regulating blade 65 and a developer accommodating portion 66 for accommodating toner. A detection window 67, which is as an example of a light transmission portion that passes light, is provided at the left and right sidewalls (only the left sidewall is shown in FIG. 2) in the developer accommodating portion 66. In addition, an agitator 66A for agitating accommodated toner is provided in the developer accommodating portion 66. The agitator 66A is rotated by input of a drive force by a development cartridge driving member 141 described later.

As shown in FIG. 3, an opening 57 is provided opposite to the detection window 67 at both sidewalls of the drum frame 52 opposed to the side wall of the development frame 62 in which the detection window 67 is provided. And, a shutter 58 that opens and shuts the opening 57 is provided at the inside of the right one of the two openings 57. That is, the shutter 58 is opposed to the detection window 67. And, a light-emitting unit 59*a* is provided opposite to the right side opening 57 in the main body housing 10 (omitted in FIG. 3), and a toner empty sensor 59*b* as an example of the first sensor is provided opposite to the left side opening 57. The toner empty sensor 59*b* is a light receiving sensor that can detect the quantity of toner by receiving light emitted from the light emitting unit 59*a* and passed through the openings 57 and the detection window 67.

The shutter 58 described above is constructed so that the shutter 58 opens the openings 57 in line with mounting of the development cartridge 61 in the photosensitive cartridge 51 and shuts the openings 57 in line with disengagement thereof.

Figure 4A:
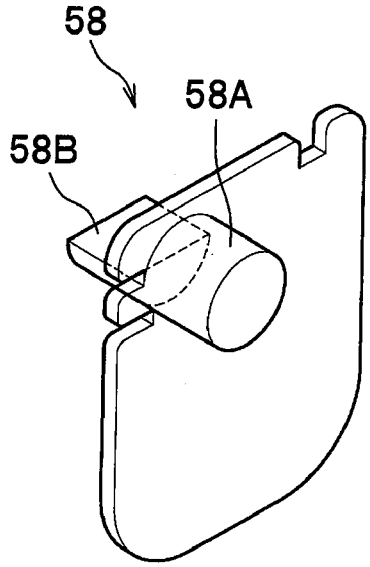
FIG. 4A is a perspective view of a shutter.
Figure 4C:
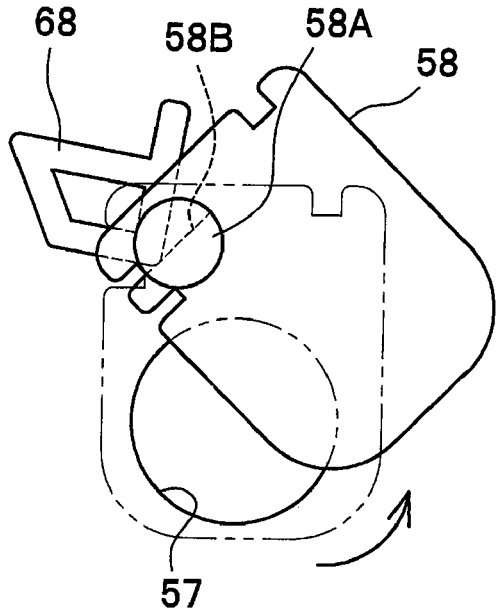
FIG. 4B to FIG. 4D are side views for describing movements of the shutter.
Figure 4B:
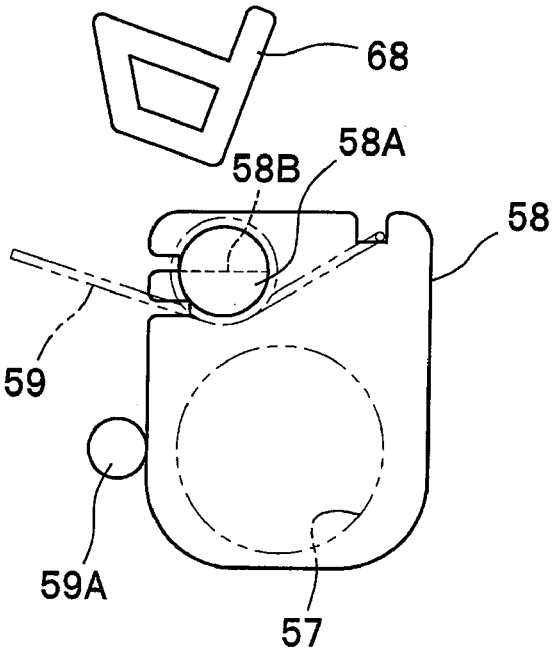
Figure 4D:
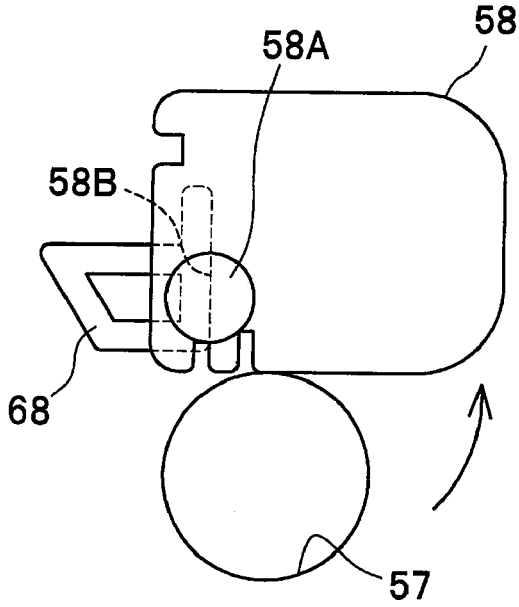

A configuration similar to that of Japanese unexamined patent application publication No. JP-A-2007-079121 may be adopted as such a configuration which opens and shuts the openings 58. A detailed description is given of the configuration with reference to FIGS. 4A to 4D. FIG. 4A is a perspective view of the shutter, FIGS. 4B to 4D are side views for describing movements of the shutter. As shown in FIG. 4A, the shutter 58 has a turning axis 58A protruding to both sides in the left and right direction and is pivotally supported at the drum frame 52 by the turning axis 58A. The turning axis 58A is shaped to be half-cut on the inside in the left and right direction. As shown in FIG. 4B, the shutter 58 is pressed clockwise in FIG. 4B by a torsion spring 59 at all times. When the development cartridge 61 is not mounted in the photosensitive cartridge 51, the shutter 58 is brought into contact with the stopper 59A, and the opening 57 is disposed at its shut position.

As the development cartridge 61 is mounted in the photosensitive cartridge 51, a shutter opening and shutting projection 68 (Refer to FIG. 3) that protrudes from the sidewall of the development cartridge 61 to the outside in the left and right direction is brought into contact with the rear half section of the half-cut side 58B described above and turns the shutter 58 (FIGS. 4B to 4C). And, as shown in FIG. 4D, when the development cartridge 61 is completely mounted in the photosensitive cartridge 51, the shutter 58 stops after having turned by 90 degrees counterclockwise from the shut position, and fully opens the opening 57. Also, although the opening 57 is located at the front side of the shutter 58 as shown in FIGS. 4B to 4D, it is illustrated with a solid line in FIG. 4D so as to understand the opening and shutting states thereof.

As shown in FIG. 1, the transfer unit 70 is provided between the sheet feeding unit 20 and respective process cartridges 50 and includes a drive roller 71, a driven roller 72, a conveyance belt 73 and transfer rollers 74.

The drive roller 71 and the driven roller 72 are separated from each other in the front-back direction and are disposed in parallel to each other, and a conveyance belt 73 consisting of an endless belt is extended therebetween. The outer surface of the conveyance belt 73 is in contact with the respective photosensitive drum 53. Also, four transfer rollers 74 that nip and support the conveyance belt 73 between the inside of the conveyance belt 73 and the respective photosensitive drums 53 are disposed opposite to the respective photosensitive drums 53 inside the conveyance belt 73. Transfer bias is applied to the transfer roller 74 by constant current control during transfer.

The fixing unit 80 is disposed behind the respective process cartridges 50 and the transfer unit 70, and includes a heating roller 81 and a pressing roller 82 that is disposed opposite to the heating roller 81 and presses the heating roller 81.

In the image forming unit 30 thus constructed, after the surface of the respective photosensitive drums 53 is uniformly charged by the charger 54, the surface thereof is exposed to light irradiated from the respective LED units 40. Therefore, the potential at the exposed portion is lowered, and an electrostatic latent image is formed on the respective photosensitive drums 53 based on the image data.

In addition, toner in the developer accommodating portion 66 is supplied to the development roller 63 by turning of the supply roller 64, and is permitted to enter between the development roller 63 and the thickness regulating blade 65 by turning of the development roller 63, and is carried on the development roller 63 as a thin film of fixed thickness.

Toner carried on the development roller 63 is supplied to the electrostatic latent image formed on the photosensitive drum 53 when the development roller 63 is opposed to and is brought into contact with the photosensitive drum 53. Therefore, toner is selectively carried on the photosensitive drum 53 to cause the electrostatic latent image to be visualized, wherein a toner image is formed by reversing development.

After that, by sheets P fed on the conveyance belt 73 passing between the respective photosensitive drums 53 and the respective transfer rollers 74 disposed inside the conveyance belt 73, toner images formed on the respective photosensitive drums 53 are transferred onto the sheets P. When the sheets P pass between the heating roller 81 and the pressing roller 82, the toner images transferred onto the sheets P are thermally fixed.

A sheet discharge unit 90 includes a discharging side conveyance path 91 that is formed so as to extend upward from the outlet of the fixing unit 80 and is turned over to the front side, and a plurality of pairs of conveyance rollers 92 for conveying sheets P. A sheet P, on which a toner image is transferred and thermally fixed, is conveyed to the discharging side conveyance path 91 by the conveyance rollers 91, is discharged outside the main body housing 10 and is accumulated in the sheet discharging tray 13.

(Configuration of New Article Detection Sensor)

In such a color printer 1 described above, since, in the exemplary embodiment, the number of times of image formation carried out by the development cartridge 61 is counted, a sensor is provided which detects whether or not the development cartridge 61 is a new one, in order to determine whether the counting is reset.

Accordingly, as shown in FIG. 1, a new article detection sensor 100 as an example of the second sensor is provided on the sidewall of the main body housing 10.

Figure 5A:
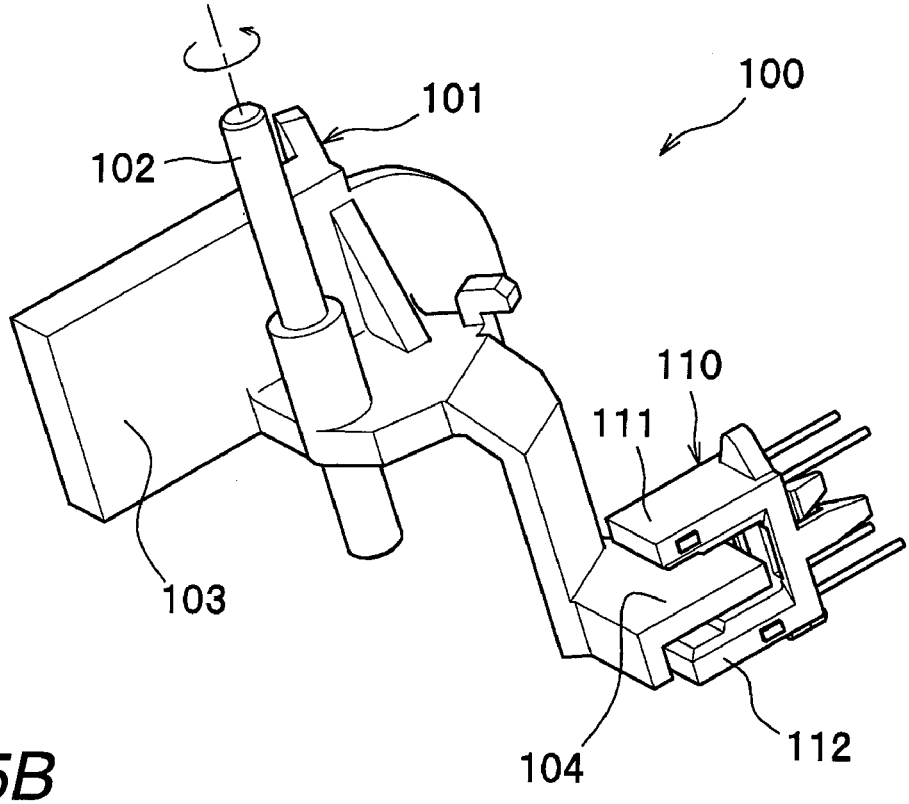
FIG. 5A is a perspective view showing a state where a new article detection sensor is not brought into contact with the development cartridge.
Figure 5B:
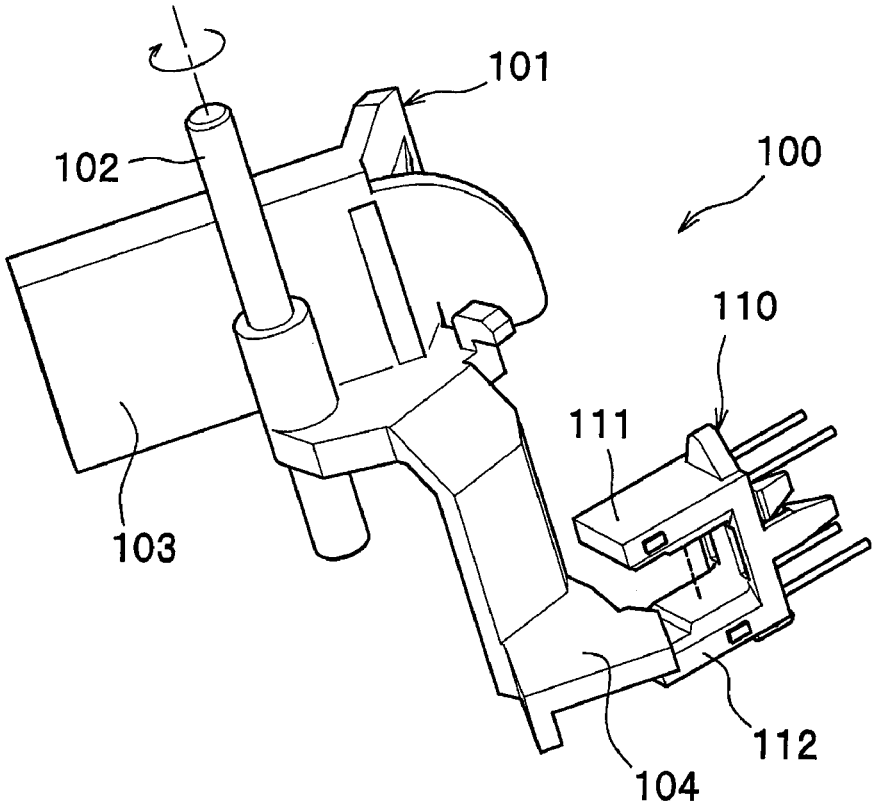
FIG. 5B is a perspective view showing a state where a new article detection sensor is brought into contact with the development cartridge.
Figures 6A, 6B:
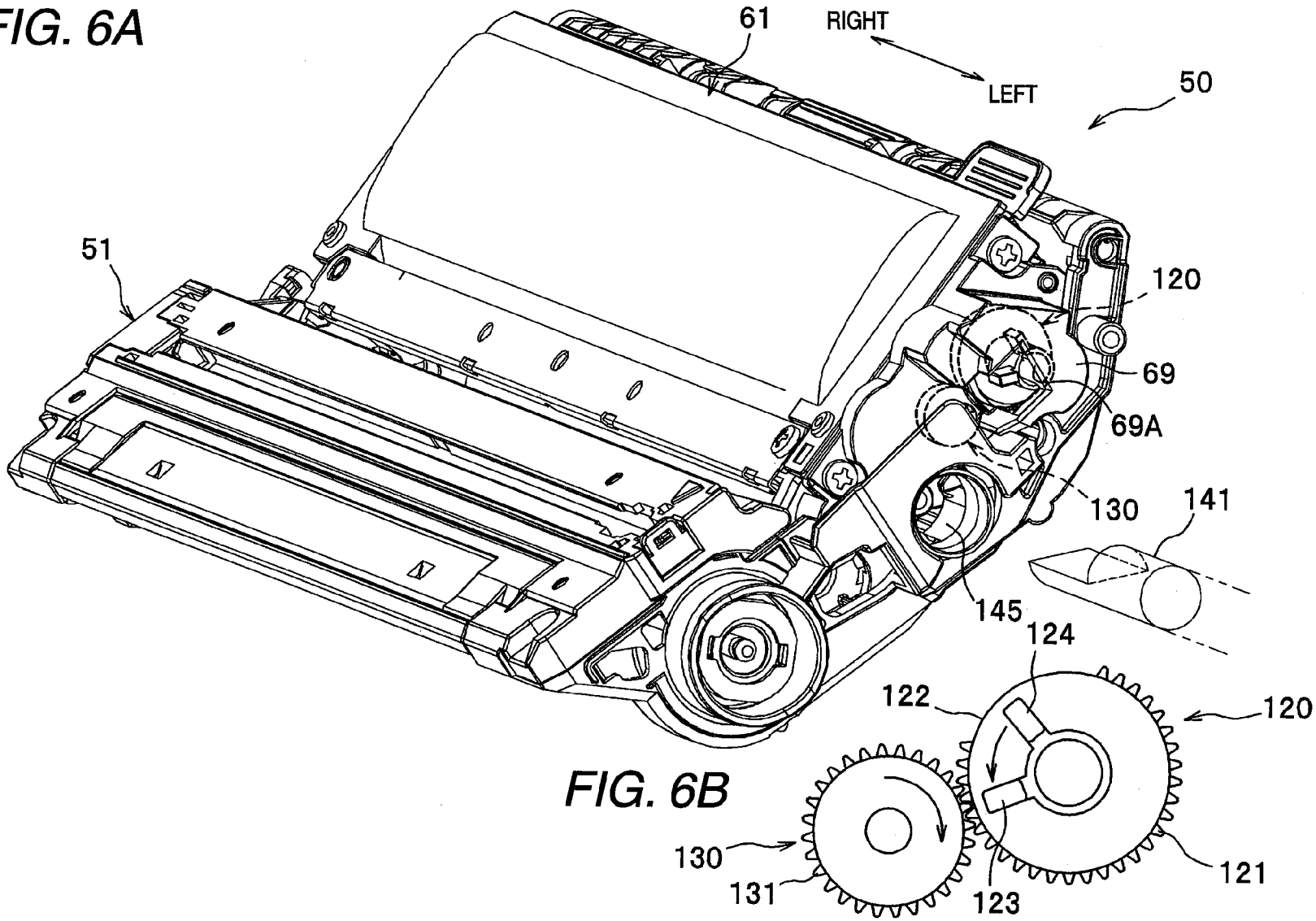
FIG. 6A is a perspective view of the process cartridge from being observed from the left side.
FIG. 6B is a side view of a new article detection gear and a transmission gear as a new article detection member.

FIG. 5A is a perspective view showing a state where the new article detection sensor is not in contact with the development cartridge and FIG. 5B shows a state where the new article detection sensor is in contact with the development cartridge, and FIG. 6A is a perspective view showing the process cartridge when being observed from the left side, and FIG. 6B is a side view showing a new article detection gear and a transmission gear, which are a new article detection member,.

The new article detection sensor 100 includes a detection member 101 and an optical sensor 110 as shown in FIG. 5A. The detection member 101 is supported on the main body housing 10 so as to turn around an axis 102. At the detection member 101, a contacting arm 103 and a shielding arm 104 extend from the axis 102. The optical sensor 110 includes a light-emitting portion 111 and a light receiving portion 112, and is constructed so that the optical sensor 110 receives light, which is emitted from the light emitting portion 111, by the light receiving portion 112.

The detection member 101 is pressed in the direction shown in FIG. 5A by a spring (not illustrated) at all times. The shielding arm 104 is brought in between the light emitting portion 111 and the light receiving portion 112 of the optical sensor 110 in a state where the development cartridge 61 is not put, that is, in a state where no force is given from the outside to the detection member 101, and the shielding arm 104 shields light emitted from the light emitting portion 111. After that, as the development cartridge 61 is brought into contact with the contacting arm 103 of the detection member 101, the detection member 101 turns around the axis 102 as shown in FIG. 5B, and is retracted to the position where the shielding arm 104 is not faced to the light emitting portion 111, wherein the light receiving portion 112 receives light.

In the exemplary embodiment, it is assumed for convenience that the light receiving portion 112 is turned ON (that is, in the second state) where the light receiving portion 112 receives light of the light emitting portion 111, and is turned OFF (that is, in the first state) where the former does not receive the light of the latter.

Next, a description is given of the portion, for actuating the new article detection sensor 100, of the development cartridge 61. As shown in FIG. 6A, a gear cover 69 is provided at the left side face of the development cartridge 61. A new article detection gear 120 as an example of the first gear and a transmission gear 130 as an example of the second gear are provided in the gear cover 69. That is, the new article detection gear 120 and the transmission gear 130 are one example of the new article detection member.

The new article detection gear 120 includes a gear portion 121 having gear teeth on its periphery and a tooth-free portion 122 having no gear tooth.

The transmission gear 130 has its periphery opposed to the periphery of the new article detection gear 120. And, the periphery thereof includes gear teeth 131.

The new article detection gear 120 is provided with two projections, which are the first projection 123 and the second projection 124, at the side thereof. The first projection 123 and the second projection 124 are disposed so as to be separated from each other with a predetermined angle centering around the turning center of the new article detection gear 120.

An opening 69A opened to the mounting side (that is, at the photosensitive drum 53 side) of the process cartridge 50 is provided in the gear cover 69. The new article detection gear 120 is exposed from the opening 69A, and where the development cartridge 61 is a new one, the new article detection gear 120 is arranged in such a posture as shown in FIG. 6B which shows the development cartridge 61 from the left side thereof, that is, in such a posture that the first projection 123 is faced in the mounting direction of the process cartridge 50. At this time, the gear portion 121 of the new article detection gear 120 is engaged with the gear teeth 131 of the transmission gear 130, wherein a turning drive force of the transmission gear 130 is transmitted to the new article detection gear 120.

The development cartridge 61 has a coupling 145, which receives a drive force from the outside, at the left side face thereof, and a development cartridge drive member 14 that drives members in the development cartridge 61, is inserted from the main body housing 10 into the coupling 145. The development cartridge drive member 141 is devised so as to be turned by a motor 142 (Refer to FIG. 8). After that, a drive force input by turning of the development cartridge drive member 141 via the coupling 145 is transmitted to the transmission gear 130 by means of a gear train.

Figure 7A:
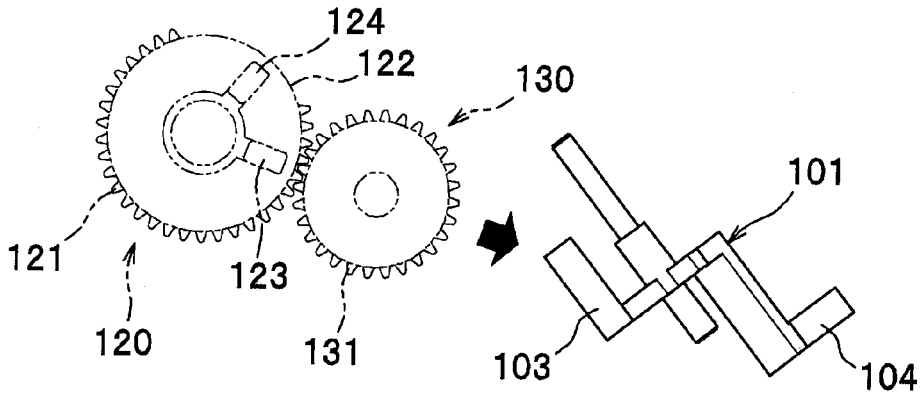
FIGS. 7A to 7D are views showing movements of the new article detection sensor.
Figure 7B:
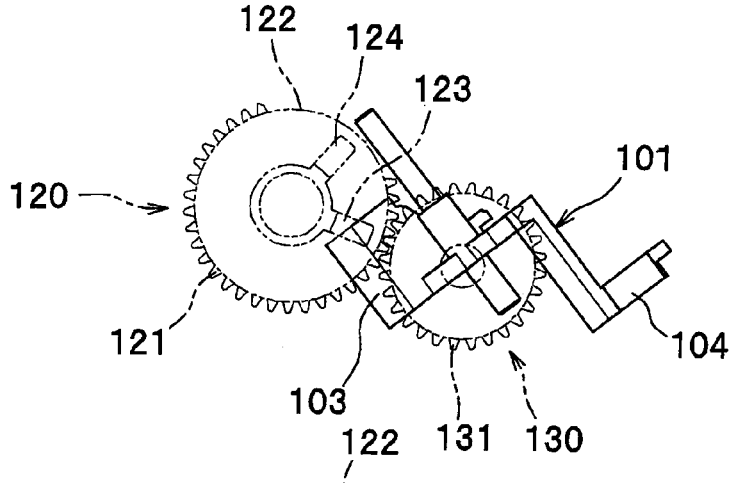
Figure 7C:
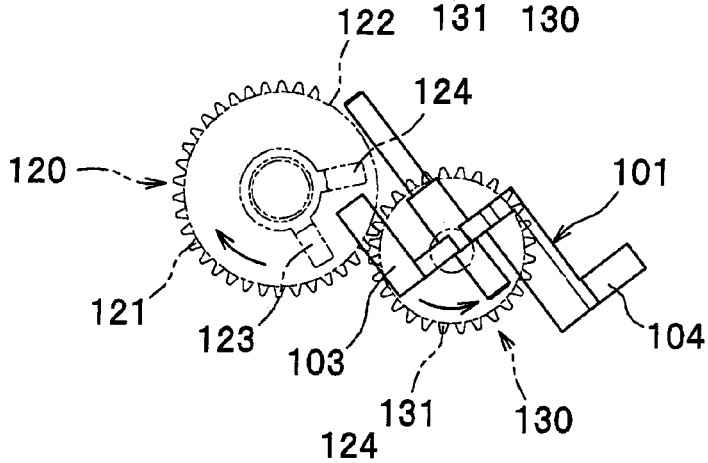
Figure 7D:
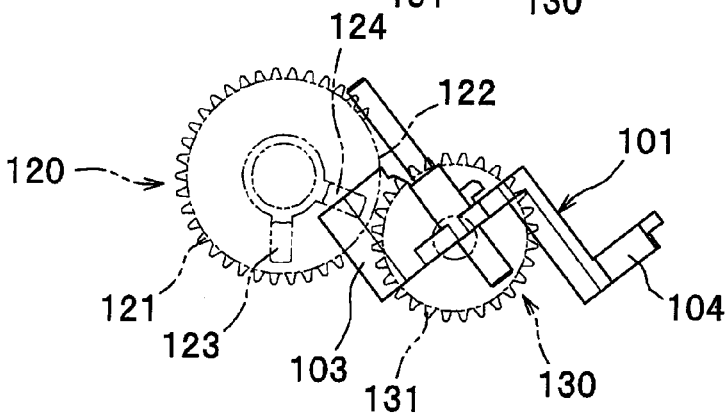

A description is given of movements of the new article detection sensor 100 based on the configuration of such a new article detection gear 120 with reference to FIGS. 7A to 7D. FIGS. 7A to 7D are views showing the movements of the new article detection sensor, wherein FIG. 7A shows a state before the process cartridge is mounted on the main body housing, FIG. 7B shows a state where mounted, FIG. 7C shows a state after a drive force is input in the development cartridge for a predetermined period of time, and FIG. 7D shows a state after a drive force is further input in the development cartridge.

As shown in FIG. 7A, before the process cartridge 50 (the entire illustration is omitted) is mounted in the main body housing, the detection member 101 and the development cartridge 61 are not brought into contact with each other, and the new article detection sensor 100 is in the OFF state. And, as shown in FIG. 7B, when the process cartridge 50 is mounted in the main body housing 10, the first projection 123 of the new article detection gear 120 is brought into contact with the contacting arm 103, and the detection member 101 turns. As the detection member 101 turns, the light receiving portion 112 of the optical sensor 110 receives light of the light emitting portion 111, wherein the new article detection sensor 100 is turned ON. At this time, the state of the new article detection gear 120 and the transmission gear 130 is referred to as "new article state."

As a drive force is input in the development cartridge 61 by the development cartridge drive member 141 and the transmission gear 130 turns by a predetermined angle counterclockwise in FIGS. 7A to 7D, as shown in FIG. 7C, the gear teeth 131 are engaged with the gear portion 121 of the new article detection gear 120, and the new article detection gear 120 turns, wherein the contacting arm 103 is brought in between the first projection 123 and the second projection 124, and the contacting arm 103 is temporarily separated from the development cartridge 61. After that, the new article detection sensor 100 is brought into an OFF state. At this time, the state of the new article detection gear 120 and the transmission gear 130 may be referred to as a "new article-detected state."

As a drive force is further input in the development cartridge 61 by the development cartridge drive member 141 and the transmission gear 130 further turns boa predetermined angle counterclockwise in FIGS. 7A to 7D, the new article detection gear 120 turns to the direction at which the gear teeth 131 is disengaged from the gear portion 121 of the new article detection gear 120 as shown in FIG. 7D, and the gear teeth 131 is faced to the tooth-free portion 122 of the new article detection gear 120. In the posture of the new article detection gear 120, the second projection 124 is made coincident with the position of the contacting arm 103, whereby the contacting arm 103 turns to cause the optical sensor 110 to be turned ON again. At this time, the state of the new article detection gear 120 and the transmission gear 130 may be referred to as a "new article detection-completed state." After being brought into the new article detection-completed state, since the transmission gear 130 is disengaged from the new article detection gear 120, the new article detection gear 120 does not change its posture and remains stopped even if the transmission gear 130 is turned. That is, transition in the posture of the new article detection member (the new article detection gear 120 and the transmission gear 130) is irreversible.

(Configuration of Control Unit)

Next, a description is given of a control unit 200 for determining, based on outputs of the toner empty sensor 59*b* and the new article detection sensor 100, whether toner exists in the developer accommodating portion 66, whether the photosensitive cartridge 51 is mounted, and whether the development cartridge 61 is mounted. In the drawings referred to, FIG. 8 is a block diagram of the control unit, FIG. 9 is a flowchart of determination process in the control unit, and FIG. 10 is a table showing the relationship between determination conditions and results in the control unit.

Figure 8:
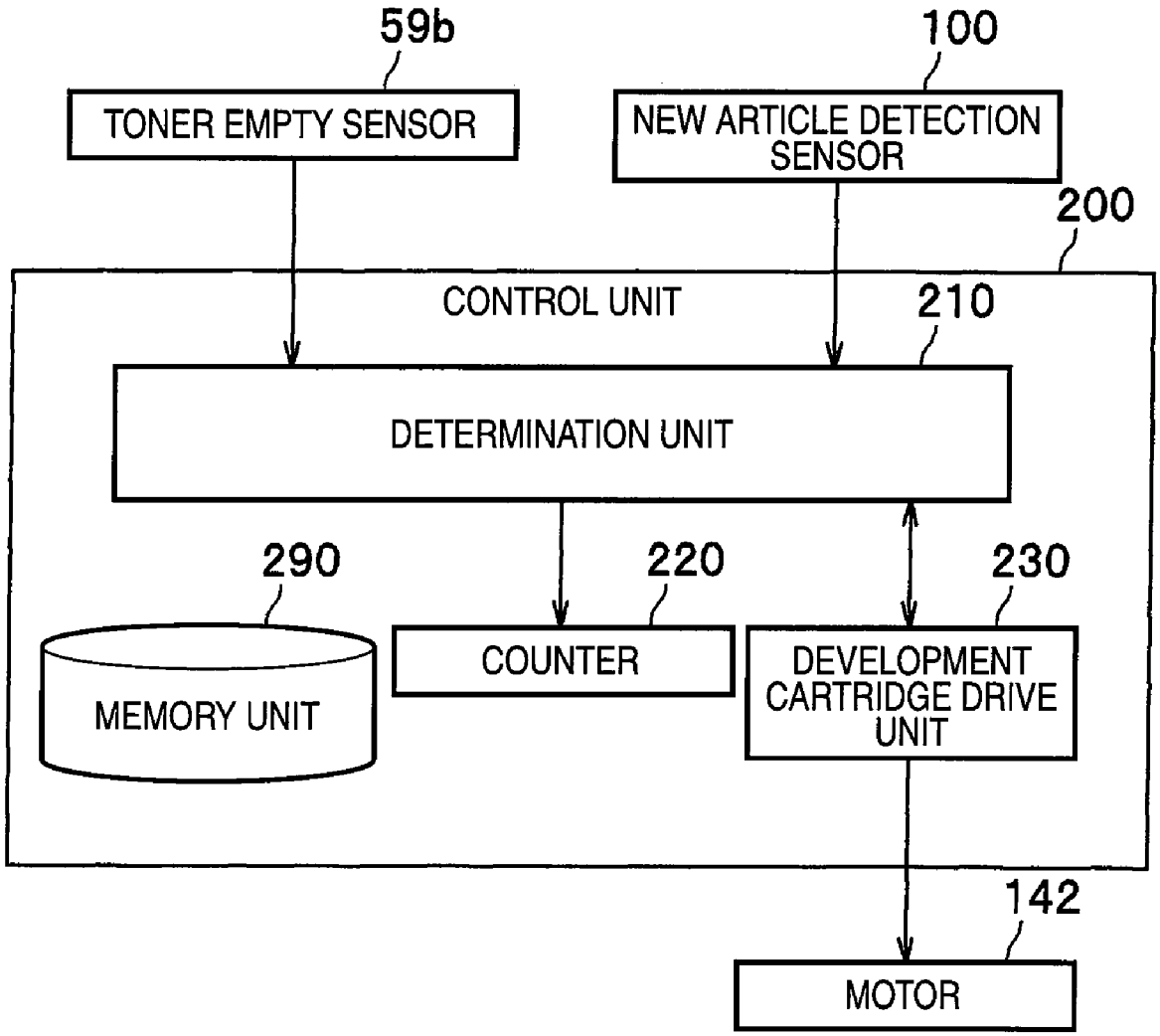
FIG. 8 is a block diagram showing a control unit.
Figure 9:
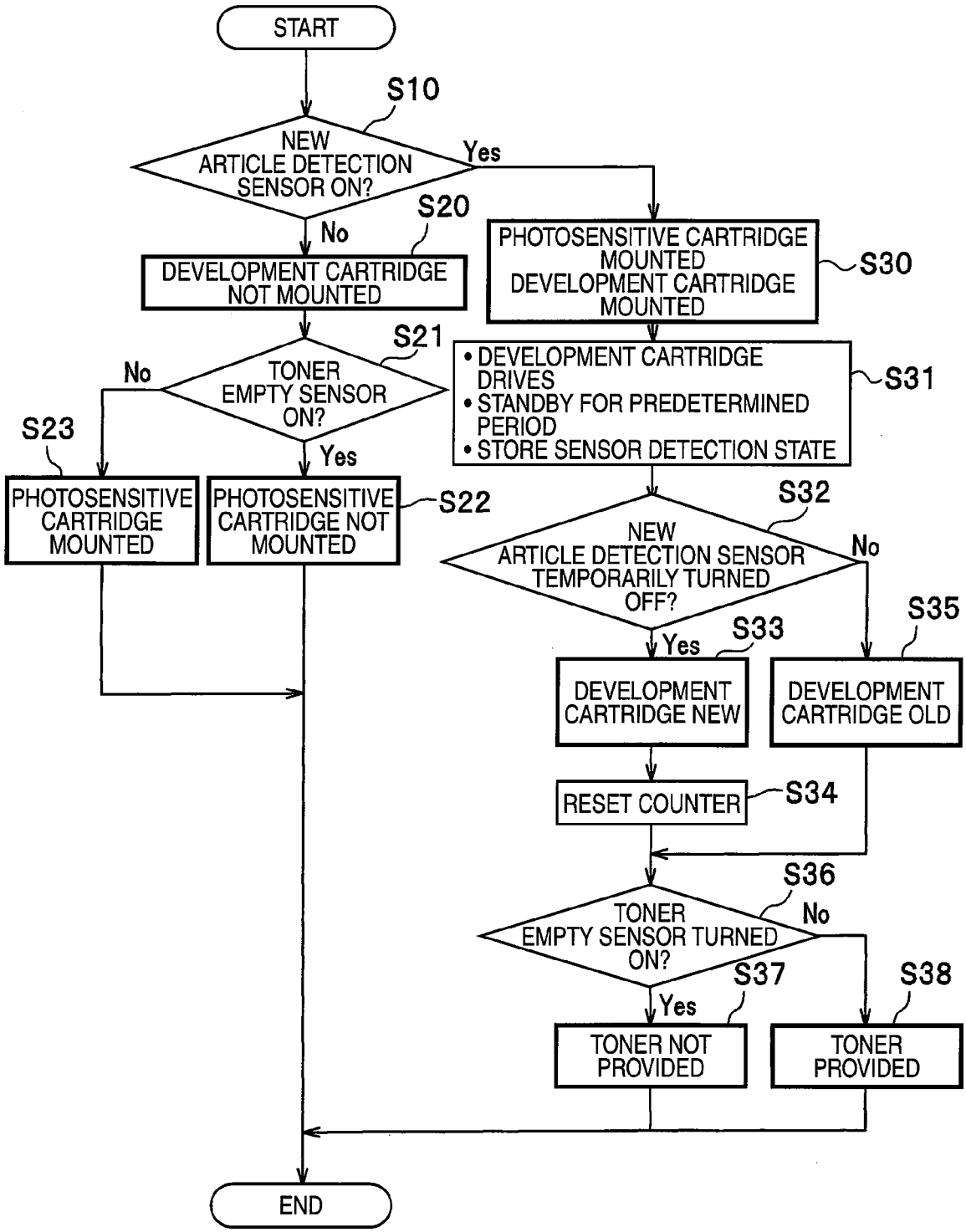
FIG. 9 is a flowchart of determination processes in the control unit.

As shown in FIG. 8, the control unit 200 includes a determination unit 210, a counter 220, a development cartridge drive unit 230, and a memory unit 290.

Outputs of the toner empty sensor 59*b* and the new article detection sensor 100 are input in the determination unit 210, and the determination unit 210 determines whether toner exists in the developer accommodating portion 66, whether the photosensitive cartridge 51 is mounted, and whether the development cartridge 61 is mounted, and outputs the results thereof to the counter 220 and the development cartridge drive unit 230.

The process for the determination unit 210 to determine whether toner exists is similar to those described in related arts such as Japanese unexamined patent application publication No. JP-A-2007-079121 and other documents, and the existence of toner is determined by the ratio R for the light detected by the toner empty sensor 59*b* to occupy the unit period of measurement. The determination process based on the ratio R is the same as in the related art. Therefore, in the following description of the exemplary embodiment, existence of toner is simply determined only by turning-ON or turning-OFF of the toner empty sensor 59*b* for understanding of the invention. Also, as described later, ON and OFF of the toner empty sensor 59*b* are used for determination on whether the photosensitive cartridge 51 is mounted, by combination of the status of the new article detection sensor 100.

A description is given later of a processing method of the determination unit 210 with reference to FIG. 10.

Under the condition that the determination unit 210 determines that the photosensitive cartridge 51 and the development cartridge 61 are mounted, the counter 220 counts the number of times of image formation for each of the photosensitive cartridge 51 and the development cartridge 61 and stores the result in the memory unit 290. And, when the counted number of times exceeds a predetermined value stored in the memory unit 290 in advance, the counter 220 outputs a warning instruction. For example, the counter outputs an instruction so that a message to urge a user to replace the photosensitive cartridge 51 is displayed on the operation panel.

In addition, the counter 220 resets the counting of the development cartridge 61 to 0 when the determination unit 210 determines that the development cartridge 61 is a new one.

The development cartridge drive unit 230 outputs a signal to rotate a motor 142 in response to an instruction of the determination unit 210 or an instruction of an image forming control unit. Rotation of the motor 142 rotates the development cartridge drive member 141 and drives the development cartridge 61.

A description is given of a determination process carried out by the determination unit 210. As shown in the first column of FIG. 10, where the new article detection sensor 100 is turned on again after it is turned on and is temporarily turned off, it is determined that the development cartridge 61 is mounted, and the mounted development cartridge 61 is a new one. The determination is carried out after the development cartridge drive member 141 is driven for a predetermined period of time. Therefore, since there is a possibility for the development cartridge 61 to have been replaced with a new one when the upper cover 12 is closed after it is opened, the determination unit 210 outputs an instruction to the development cartridge drive unit 230 to drive the development cartridge 61 for a predetermined period of time.

And, as shown in the second column and the third column, where the new article detection sensor 100 is continuously kept turned ON for a predetermined period of time, it is determined that the development cartridge 61 is mounted.

Further, where the development cartridge 61 is mounted, it is determined, as shown in the first column through the third column, that both the development cartridge 61 and the photosensitive cartridge 51 are mounted. This is because the development cartridge 61 cannot be mounted unless the photosensitive cartridge 51 is mounted.

As described above, where it is determined that the development cartridge 61 is mounted, output of the toner empty sensor 59*b* is used for determination on whether toner exists. That is, as shown in the first column through the third column, the determination unit 210 determines that, if the toner empty sensor 59*b* is turned on, no toner is provided, and if the toner empty sensor 59*b* is turned off, toner exists.

On the other hand, since nothing is brought into contact with the detection member 101 where the output of the new article detection sensor 100 is OFF, it is determined, as shown in the fourth column and the fifth column, that the development cartridge 61 is not mounted.

And, in this case, since the shutter 58 is shut, that is, the shutter 58 exists where the toner empty sensor 59*b* is continuously kept turned OFF within a predetermined period of time, it is determined, as shown in the fourth column, that the photosensitive cartridge 51 exists. On the other hand, since light is not interrupted by the shutter 58, that is, the shutter 58 does not exist if the toner empty sensor 59*b* is turned ON within a predetermined period of time, it is determined, as shown in the fifth column, that the photosensitive cartridge 51 does not exist.

In addition, where it determined, as shown in the fourth column and the fifth column, that the development cartridge 61 is not mounted, determination of the photosensitive cartridge 51 may be commenced based on output of the toner empty sensor 59*b* without continuously inputting the output result of the new article detection sensor 100 for a predetermined period of time.

(Actions)

A description is given of the color printer 1 constructed as described above. When a user carries out maintenance of the color printer 1, the user appropriately opens the upper cover 12, takes out the process cartridge 50, and replaces the development cartridge 61 and the photosensitive cartridge 51, etc. At this time, as in the related art printer, initial actions are carried out, in which it is determined whether or not respective cartridges are replaced after detecting that the upper cover 12 is closed.

When the development cartridge 61 is not replaced with a new one, the new article detection gear 120 and the transmission gear 130, which compose the new article detection member, are in the posture shown in FIG. 7D, and cause the new article detection sensor 100 to be kept on after being mounted. On the other hand, the new article detection gear 120 and the transmission gear 130 are mounted in the posture shown in FIG. 7A where the development cartridge 61 is replaced with a new one. Therefore, if the development cartridge drive member 141 is driven by the development cartridge drive unit 230 for a predetermined period of time, the new article detection gear 120 and the transmission gear 130 turn as shown in FIGS. 7B to 7D, and the new article detection sensor 100 changes to ON, OFF and ON.

And, where the photosensitive cartridge 51 is not mounted, the toner empty sensor 59*b* continuously receives light of the light emitting unit 59*a* since the shutter 58 is not provided, and is turned ON. Where the photosensitive cartridge 51 is mounted and the development cartridge 61 is not mounted, the toner empty sensor 59*b* is turned OFF since the light of the light emitting unit 59*a* is interrupted by the shutter 58. Further, where both the photosensitive cartridge 51 and the development cartridge 61 are mounted, the toner empty sensor 59*b* receives light of the light emitting unit 59*a* in accordance with rotation of the agitator 66A and the quantity of toner. Also, as described above, it is assumed herein that, by simplifying the configuration for understanding of the invention, the toner empty sensor 59*b* is turned ON when no toner is provided, and the toner empty sensor 59*b* is turned OFF when toner is provided.

And, the determination unit 210 of the control unit 200 carries out determination processing in accordance with the flowchart of FIG. 9 in response to output of the new article detection sensor 100 and the toner empty sensor 59*b*. Also, in FIG. 9, the determination processing is shown in bold frames.

As shown in FIG. 9, the determination unit 210 determines (S10) whether or not the new article detection sensor 100 is turned ON. And, where the new article detection sensor 100 outputs OFF (S10: NO), nothing is brought into contact with the detection member 101, wherein it is determined that the development cartridge 61 is not provided (S20). And, it is determined whether or not the toner empty sensor 59*b* is turned ON (S21). Where it is turned ON (S21: YES), the shutter 58 is not provided, wherein it is determined that the photosensitive cartridge 51 is not provided (S22). On the other hand, where the toner empty sensor 59*b* is turned OFF (S21: NO), light is interrupted by the shutter 58, wherein it is determined that the photosensitive cartridge 51 is provided (S23).

On the other hand, where the new article detection sensor 100 is turned ON (S10: YES), the development cartridge 61 is brought into contact with the detection member 101, and the photosensitive cartridge 51 is mounted if the development cartridge 61 is provided. Therefore, it is determined that both the development cartridge 61 and the photosensitive cartridge 51 are provided (S30). And, the development cartridge 61 is driven by moving the development cartridge drive member 141 by means of the motor 142, and the determination unit 210 is brought into stand-by for a predetermined period of time in the drive state. The detection details of the sensor during standby are stored in the memory unit 290 (S31).

After stand-by for a predetermined period of time, the determination unit 210 determines whether or not the new article detection sensor 100 is temporarily turned OFF (S32). Where the new article detection sensor 100 is temporarily turned OFF (S32: YES), it is determined that the development cartridge 61 is a new one (S33), and the counter showing the service life of the development cartridge 61 is reset to 0 (S34). On the other hand, where the new article detection sensor 100 is not temporarily turned OFF, that is, where the new article detection sensor 100 is kept turned ON for a predetermined period of time (S32: NO), it is determined that the development cartridge 61 is not a new one (hereinafter called an "old one") (S35).

Next, it is determined whether or not the toner empty sensor 59*b* is turned ON (S36). Where the sensor is turned ON (S36: YES), it is determined that the toner is not provided (S37). If the sensor is turned OFF (S36: NO), it is determined that toner is provided (S38).

As described above, according to the color printer 1 of the exemplary embodiment, although there is no exclusive sensor for each of the development cartridge 61 and the photosensitive cartridge 51, it is possible to determine, at high accuracy, whether the development cartridge 61 and the photosensitive cartridge 51 exist. And, where it is determined that there is no toner, the development cartridge 61 is not mounted, and the photosensitive cartridge 51 is not mounted, the control unit 200 causes the display panel to display a warning message corresponding thereto. On the other hand, where the development cartridge 61 and the photosensitive cartridge 51 are mounted, and there is toner, the counter 220 counts the number of times of image formation carried out by the development cartridge 61 and the photosensitive cartridge 51 whenever forming images.

The control unit 200 can determine whether the development cartridge 61 and the photosensitive cartridge 51 are mounted, effectively utilizing the detection results of the new article detection sensor 100 by determining, when the sensor 100 is turned ON, that both the development cartridge 61 and the photosensitive cartridge 51 are mounted.

Further, since, after the control unit 200 drives the development cartridge drive member 141 for a predetermined period of time, the control unit 200 determines whether or not the development cartridge 61 is a new one, based on output of the new article detection sensor 100, it can be determined whether or not the new article detection sensor 100 is temporarily turned OFF. On the other hand, since the control unit 200 can determine whether the photosensitive cartridge 51 is mounted, based on output of the toner empty sensor 59*b* without waiting for a predetermined period of time where the new article detection sensor 100 is turned OFF, it is possible to quickly determine whether the development cartridge 61 and the photosensitive cartridge 51 are mounted, where the development cartridge 61 is not mounted.

As described above, determination on whether the development cartridge 61 and the photosensitive cartridge 51 are mounted is particularly important in an image forming apparatus such as a color printer, a copy machine, etc., as in the exemplary embodiment. In a color image forming apparatus, monochrome printing may be carried out by separating developing rollers 63 of cyan, magenta and yellow developers other than a black developer from the photosensitive drum 53 where any developer other than black becomes empty. Under the condition that it is determined that the photosensitive cartridge 51 and the development cartridge 61 are mounted, the control unit 200 of the exemplary embodiment counts the number of times of image formation for each of the photosensitive cartridge 51 and the development cartridge 61, and stores the result thereof in the memory unit 290. And, the control unit 200 outputs an instruction to issue a warning when the corresponding count exceeds a predetermined value. That is, in a color image forming apparatus to which the present invention is applied, for example, if a photosensitive cartridge 51 corresponding to cyan color is not mounted, the number of times of image formation by the photosensitive cartridge 51 for cyan color is not counted. And; if the photosensitive cartridge 51 is mounted, the photosensitive drum 53 turns in line with image formation, and the number of times of image formation is counted. Further, when the monochrome printing is carried out, since the development roller 63 of the development cartridge 61 is separated from the photosensitive drum 53 even if the cyan development cartridge 61 is mounted, it is not necessary to count up the number of times of image formation of the development cartridge 61. In a related art image forming apparatus, since it is not possible to securely determine whether or not the photosensitive cartridge 51 is mounted, the number of times of image formation is counted up even in regard to a photosensitive cartridge 51 not being mounted, as a result, there is a concern that a warning is issued to a user at an earlier timing than the actual service life of the photosensitive cartridge 51. However, according to the image forming apparatus of the exemplary embodiment, such a disadvantage can be prevented from occurring.

In addition, the present invention is not limited to the above exemplary embodiment, but it may be subjected to various modes exemplarily shown below.

In the above exemplary embodiment, a description was given of a case where the present invention is applied to an image forming apparatus for color printing. However, the present invention may be applicable to an image forming apparatus for monochrome printing. In addition, the exposure member is not limited to a LED unit 40. The present invention may be applied to cases where a laser exposure device, which has been conventionally known, is used.

In the above exemplary embodiment, such a case is shown, in which the new article detection sensor 100 is configured so as to be irreversibly turned ON, turned off and turned ON again when the development cartridge 61 is a new one, and a new article detection gear 120 having a tooth-free portion 122 and a geared portion 121 incorporated therein is used. However, the new article detection member is not limited to the above described configuration. Also, although a state where the development cartridge 61 is mounted is referred to as [ON] with respect to the state of the new article detection sensor 100, this is only for convenience. It is a matter of course that the state may be referred to as [OFF]. With respect to the toner empty sensor 59*b* being the first sensor, [ON] and [OFF] in the embodiment are only called these for convenience.

In the above exemplary embodiment, although such a case is shown in which the detection window 67 is provided in the development cartridge 61 as an example of the light transmission portion, it may be constructed that the entirety of the development frame 62 of the development cartridge 61 is made transparent.

In the above exemplary embodiment, such a case where the upper cover 12 is closed is shown as the timing at which the determination unit 210 determines whether the development cartridge 61 and the photosensitive cartridge 51 are mounted, and whether toner is provided. However, the timing of determination is not limited thereto. Determination may be carried out whenever an image is formed.

What is claimed is:

1. An image forming apparatus, comprising:

a photosensitive cartridge having a photosensitive body;

a development cartridge that is detachably mounted to the photosensitive cartridge and supplies developer to the photosensitive body; and a main body in which the photosensitive cartridge is detachably mounted;

wherein the development cartridge includes:

a developer accommodating portion; and a light transmission portion formed on the developer accommodating portion, the main body includes:

a first sensor that is configured to detect light passing through the light transmission portion;

a second sensor that is configured to be movable between a first state and a second state by being brought into contact with the development cartridge when the development cartridge is mounted in the main body;

a development cartridge driving member that is configured to drive a member in the development cartridge in engagement with the development cartridge; and a control unit that is configured to determine, based on outputs of the first sensor and the second sensor, whether the developer exists in the developer accommodating portion, whether the photosensitive cartridge is mounted, and whether the development cartridge is mounted, wherein the development cartridge further includes:

a new article detecting member that is a portion configured to be brought into contact with the second sensor and moves by drive of the development cartridge driving member, the new article detecting member configured such that, by drive of the development cartridge driving member, the new article detecting member is irreversibly moved to a new article state where the new article detecting member is brought into contact with the second sensor, to a new article-detected state where the new article detecting member is separated from the second sensor, and to a new article detection-completed state where the new article detecting member is again brought into contact with the second sensor, in order, and is thereafter stopped, the photosensitive cartridge further includes:

a shutter that is disposed to be opposed to the light transmission portion, the shutter configured to open the light transmission portion in line with mounting of the development cartridge in the photosensitive cartridge, and configured to shut the light transmission portion in line with separation of the development cartridge, and wherein the control unit is configured to determine, when the second sensor is brought into the second state after the second sensor is temporarily brought into the first state, that the development cartridge is a new article, the control unit configured to determine, when the second sensor is in the first state and the first sensor receives the light within a predetermined period of time, that both the photosensitive cartridge and the development cartridge are not mounted, and the control unit configured to determine, when the second sensor is in the first state and the first sensor does not receive the light continuously for a predetermined period of time, that the photosensitive cartridge is mounted and the development cartridge is not mounted.

2. The image forming apparatus according to claim 1, wherein the new article detecting member includes a first gear that comprises a tooth-free portion having no gear tooth and a gear portion having gear teeth on the circumference thereof, and a second gear engageable with the gear portion of the first gear;

the first gear includes a first projection brought into contact with the second sensor at the new article state and a second projection brought into contact with the second sensor in the new article detection-completed state; and the second gear is configured so as to turn by drive of the development cartridge driving member.

3. The image forming apparatus according to claim 1, wherein the control unit is configured to determine, when the second sensor is in the second state, that both the development cartridge and the photosensitive cartridge are mounted.

4. The image forming apparatus according to claim 1;

wherein the control unit is configured to determine whether or not the development cartridge is a new article, based on output of the second sensor after the development cartridge driving member is driven for a predetermined period of time.

5. The image forming apparatus according to claim 1, wherein the control unit is configured to determine, when the second sensor is in the second state, whether or not the development cartridge is a new article based on output of the second sensor after the development cartridge driving member is driven for a predetermined period of time, and the control unit is configured to determine, when the second sensor is in the first state, whether or not the photosensitive cartridge is mounted based on output of the first sensor without waiting for a predetermined period of time.

6. The image forming apparatus according to claim 1, further comprising:

a plurality of process cartridges, each of the process cartridges comprising the development cartridge and the photosensitive cartridge; and a plurality of the first sensors and second sensors, each of the first sensors that is disposed to be associated with a respective one of the process cartridges, each of the second sensors that is disposed to be associated with the respective one of the process cartridges, and wherein the control unit is configured to determine, with respect to the respective process cartridges, whether or not the development cartridge exists, whether or not the photosensitive cartridge exists, and whether or not the development cartridge is a new article.

7. The image forming apparatus according to claim 1, wherein the control unit is configured to count and store the number of times of image formation and configured to output an instruction to issue a warning when the counted number exceeds a predetermined value, under a determined condition that the photosensitive cartridge and the development cartridge are mounted.

8. A process cartridge detachably mounted in a main body of an image forming apparatus, the process cartridge comprising:

a photosensitive cartridge having a photosensitive body; and a development cartridge detachably mounted to the photosensitive cartridge, the development cartridge supplying developer to the photosensitive body, wherein the development cartridge includes:

a developer accommodating portion; and a light transmission portion formed on the developer accommodating portion, the main body includes:

a first sensor that is configured to detect light passing through the light transmission portion;

a second sensor that is configured to be movable between a first state and a second state by being brought into contact with the development cartridge when the development cartridge is mounted in the main body; and a development cartridge driving member that is configured to drive a member in the development cartridge in engagement with the development cartridge, wherein the development cartridge further includes:

a new article detecting member that is a portion configured to be brought into contact with the second sensor and moves by drive of the development cartridge driving member, the new article detecting member configured such that, by drive of the development cartridge driving member, the new article detecting member is irreversibly moved to a new article state where the new article detecting member is brought into contact with the second sensor, to a new article-detected state where the new article detecting member is separated from the second sensor, and to a new article detection-completed state where the new article detecting member is again brought into contact with the second sensor, in order, and is thereafter stopped, the photosensitive cartridge further includes:

a shutter that is disposed to be opposed to the light transmission portion, the shutter configured to open the light transmission portion in line with mounting of the development cartridge in the photosensitive cartridge, and configured to shut the light transmission portion in line with separation of the development cartridge.

* * * * *